United States Patent [19]

Holbrook

[11] Patent Number: 5,048,975

[45] Date of Patent: Sep. 17, 1991

[54] CONVERTIBLE BLANKET BAG

[76] Inventor: Gordon F. Holbrook, P.O. Box 598, Elma, Wash. 98541

[21] Appl. No.: 551,484

[22] Filed: Jul. 12, 1990

[51] Int. Cl.[5] ..... B65D 30/10

[52] U.S. Cl. ..... 383/4; 190/2

[58] Field of Search ..... 383/4; 190/2

[56] References Cited

U.S. PATENT DOCUMENTS

| | | | |
|---|---|---|---|
| 3,477,552 | 11/1969 | Goldman | 190/2 |
| 4,188,988 | 2/1980 | Agyagos | 150/1.7 |
| 4,197,891 | 4/1980 | Comollo | 383/4 |
| 4,723,300 | 2/1988 | Aranow | 383/4 |
| 4,738,545 | 4/1988 | Westgor | 190/2 X |
| 4,789,247 | 12/1988 | Schnoor | 383/4 |
| 4,886,150 | 12/1989 | Fitzsimmons | 190/2 X |

FOREIGN PATENT DOCUMENTS

| | | | |
|---|---|---|---|
| 233097 | 8/1987 | European Pat. Off. | 383/4 |

*Primary Examiner*—Stephen P. Garbe

*Assistant Examiner*—Jes F. Pascua

*Attorney, Agent, or Firm*—Christopher John Rudy

[57] ABSTRACT

A sheet assembly useful as a multipurpose tote bag, which may be convertible into a blanket, poncho, pad, and so forth and the like, comprises substantially one integral material sheet, adapted to be folded in a first folding operation in an overlapping manner along vertical and horizontal axes from predetermined folding lines to form a folded sheet formation in which folded portions form a top opening and two inside portions of the tote bag, and adapted to be folded in a second folding operation along a center folding axis to form a bottom of the tote bag, and adapted to be formed into its tote bag formation by means of two pairs of fastener attachments in parallel along the vertical axes, with mating parts of each fastener attachment in parallel and extending from the bottom to the top opening of the tote bag. The tote bag may have handles and/or a hood attachable and/or have an insertable pad associated with it.

4 Claims, 3 Drawing Sheets

CONVERTIBLE BLANKET BAG

FIELD

This invention concerns a sheet assembly useful as a multipurpose tote bag, which may be convertible into a blanket, poncho, pad, and so forth and the like.

BACKGROUND

Many types of bags and bag variations are known.

Certain multipurpose tote bags are known. For example, Agyagos, U.S. Pat. No. 4,188,988 (Feb. 19, 1980), discloses a sheet assembly for use as a multipurpose tote bag. In nature and gist that invention comprises two layers of waterproof material partially sewn together to form a two-piece sheet formation with an unsewn opening at a top portion, wherein the two-piece sheet formation is adapted to be folded in a first folding operation in a overlapping manner along vertical and horizontal axes from predetermined folding points to form a folded sheet formation in which the folded portions form a top opening and two inside portions of that tote bag, and wherein the folded sheet formation is further foldable in a second folding operation along a center folding axis forming the bottom of that tote bag and is adaptable for forming that tote bag by means of two pairs of fastener attachments sewn in parallel along the vertical axes, with the mating parts of each fastener attachment sewn in parallel and extending from the bottom to the top opening of that tote bag However, the art heretofore lacks and needs an improved multipurpose tote bag sheet assembly that is simple and yet has great versatility. Such a bag would be efficient to make and may be profitable to sell.

SUMMARY

The present invention provides a sheet assembly useful as a multipurpose tote bag, which comprises substantially one integral material sheet, adapted to be folded in a first folding operation in an overlapping manner along vertical and horizontal axes from predetermined folding lines to form a folded sheet formation in which folded portions form a top opening and two inside portions of the tote bag, and adapted to be folded in a second folding operation along a center folding axis to form a bottom of the tote bag, and adapted to be formed into its tote bag formation by means of two pairs of fastener attachments in parallel along the vertical axes, with mating parts of each fastener attachment in parallel and extending from the bottom to the top opening of the tote bag. The tote bag may have handles and/or a hood attachable and/or have an insertable pad associated with it, and it may be convertible into a blanket, poncho, pad, etc.

Notably, the tote bag material sheet is substantially one-piece. The material sheet has no opening, unsewn or otherwise, at its top portion, in contrast to the tote bag of Agyagos. The tote bag is simple, highly versatile, and is efficient to make. It may well enjoy commercial success.

DRAWINGS

The drawings form part of the specification hereof.

ILLUSTRATIVE DETAIL

The tote bag of the present invention can be made with known materials by known methods. Cloth and/or nylon can be quilted together in one piece, and handles, snaps, VELCRO, zippers, a hood, and so forth and the like can be pressed, sewn, snapped, riveted and/or glued on.

The bag, unfolded, may be any suitable size. For example, one embodiment measures 36 inches by 72 inches, i.e., 91 cm by 183 cm, a rectangle, and a rectangular 44-inch, i.e., 112 cm, embodiment is extant.

Figure 1:
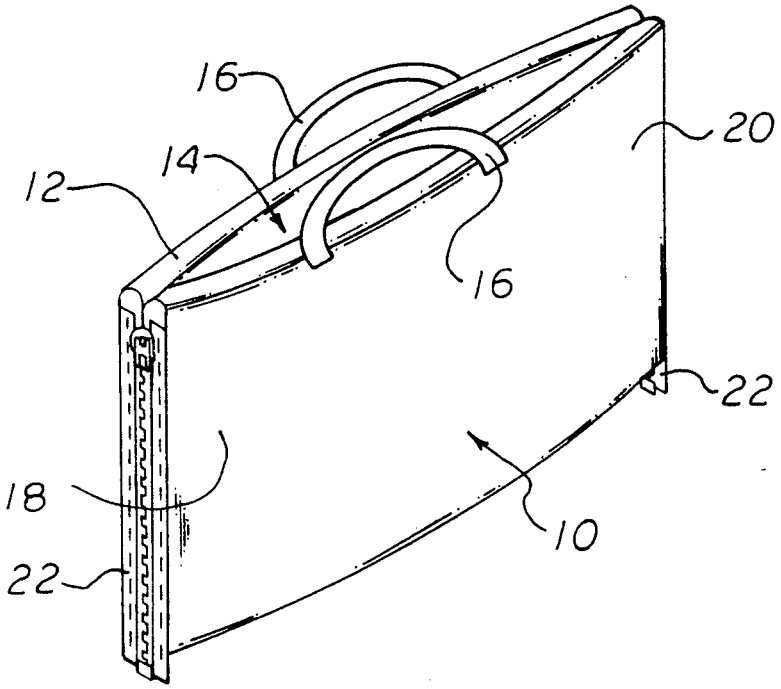
FIG. 1 is a perspective view of a multipurpose tote bag of the present invention folded in its tote bag formation.

In reference to the figures, which are not necessarily drawn to scale, and where like numerals indicate like features throughout, the following is noted:

In FIG. 1 is shown tote bag 10. When it is so folded, it becomes a cushion to sit on at sporting events or other activities; also, it can be used as a tote bag to carry objects therein. Its top portion 12 defines opening 14 to the interior of the bag for placing items therein to tote. Attached on either side of the upper portion of the tote bag are handles 16. Front and rear margins 18 & 20 respectively have zippers 22 attached thereto, the zippers being in their closed positions when the bag is in its tote bag formation.

Figure 2:
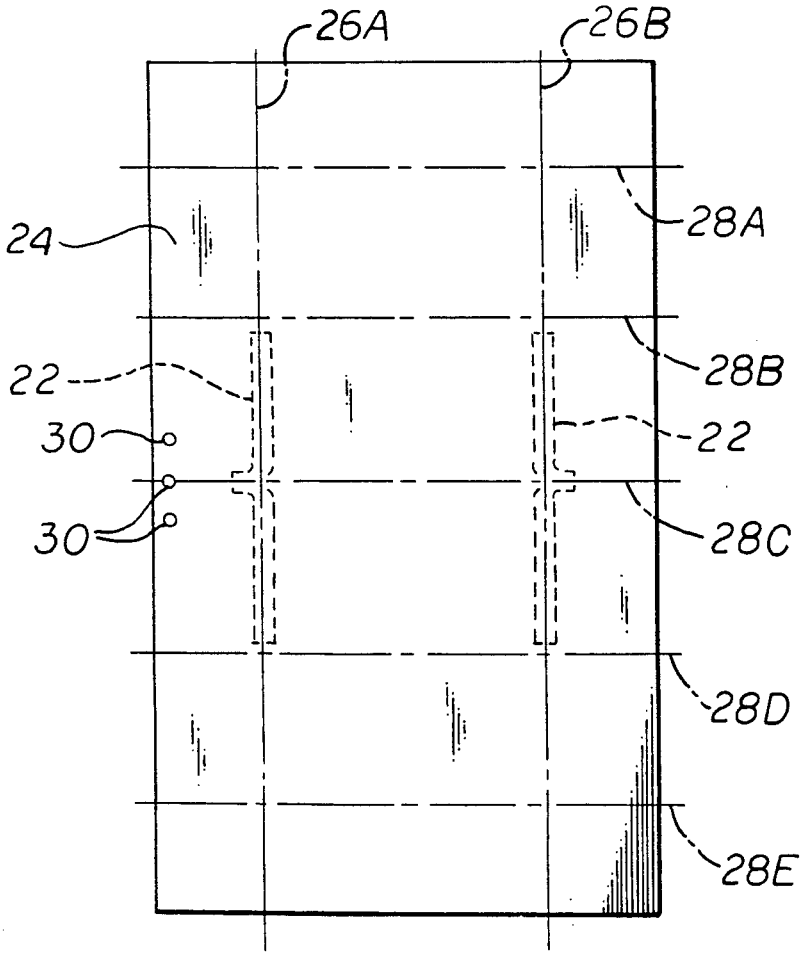
FIG. 2 is a top view of the bag of FIG. 1, unfolded.

In FIG. 2 is shown the bag converted by unfolding to a flat conformation with inside surface 24 facing upward. Vertical fold lines 26A & 26B are located one-quarter of the width from the left and right side margins of the unfolded bag. Horizontal fold lines 28A, 28B, 28C, 28D & 28E are located at equidistant intervals between the top and bottom margins of the unfolded bag, a blanket. The zippers are underneath, and snaps 30 are present.

Figure 3:
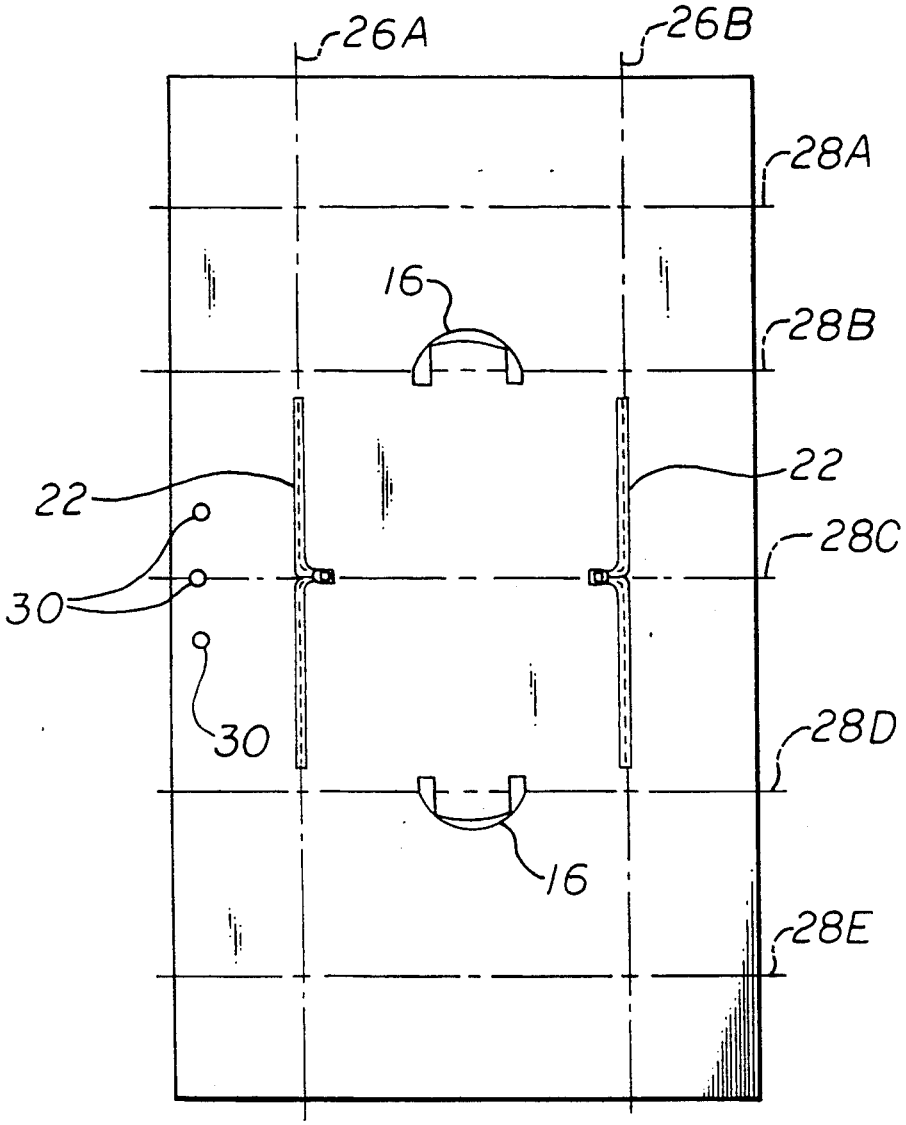
FIG. 3 is a bottom view of the bag of FIG. 2.

In FIG. 3 is shown the flat blanket with the inside surface underneath. The zippers thus are attached to the exterior of the bag, centrally disposed about the central horizontal fold line and along the vertical fold lines. The handles are located along the horizontal fold lines that begin just outside the ends of the zippers.

Figure 4:
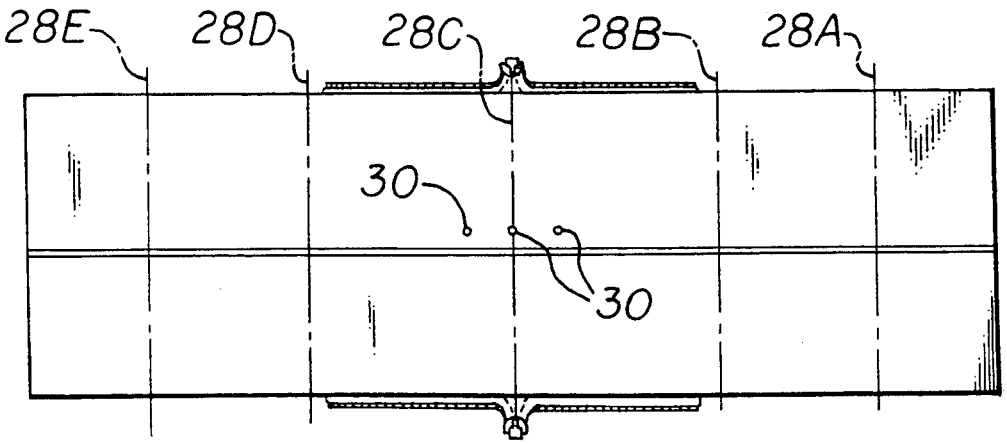
FIG. 4 is a top view of the bag of FIG. 1, partially unfolded, after vertical folds of a first folding operation.

In FIG. 4 is shown the tote bag partially folded along its vertical fold lines. This folding is part of the first folding operation in its conversion. The zippers, yet unzipped, and the snaps can be seen.

Figure 5:
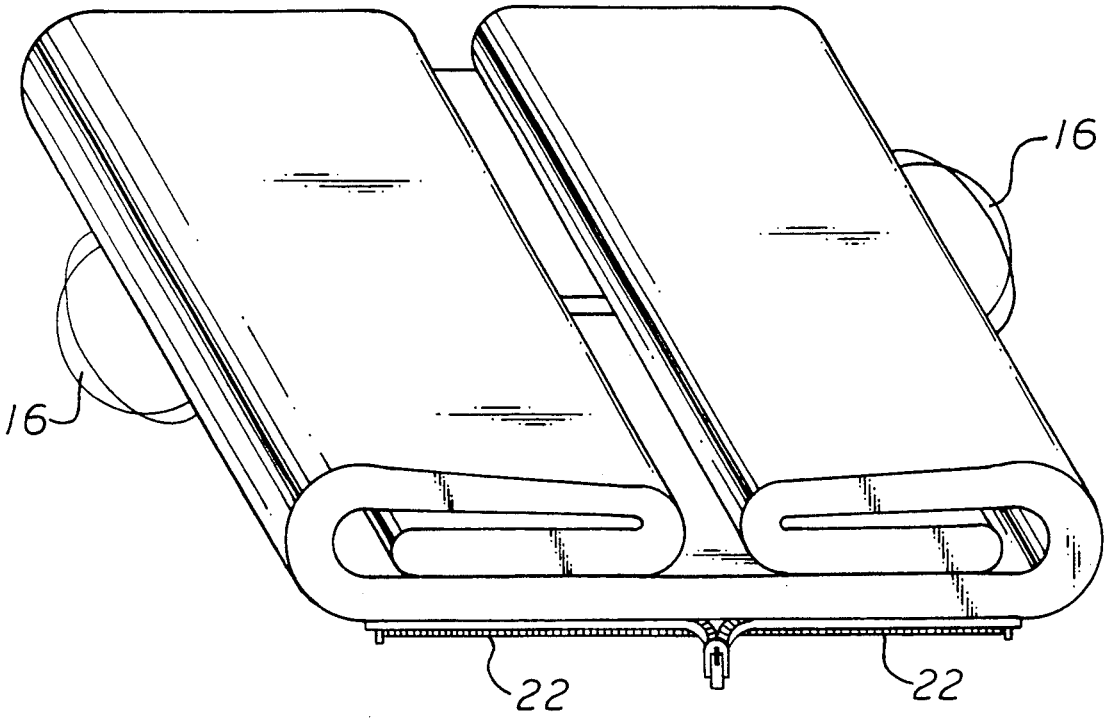
FIG. 5 is a perspective view of the bag of FIG. 1, partially unfolded, after the folds of FIG. 4 and horizontal folds of the first folding operation.

In FIG. 5 is shown the tote bag partially folded both along its vertical fold lines and four of its five horizontal fold lines. This folding completes the first folding operation. The unzipped zippers and the handles can be seen.

Figure 6:
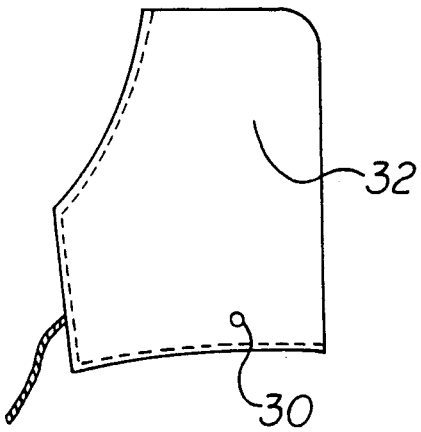
FIG. 6 is a side view of a hood attachable to the bag of FIG. 1. N.b., FIG. 2.

In FIG. 6 is shown hood 32. The hood is attachable to the blanket bag in part by snap 30, which appropriately registers with the snaps of the blanket bag for attachment. When attached, the blanket becomes a hooded poncho, the edges of which may be secured together by means for fastening, e.g., VELCRO, placed along the vertical border of the blanket near the snaps of the blanket bag.

Figure 7:
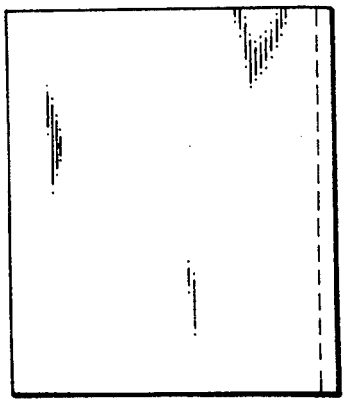
FIG. 7 is a top view of a pad insertable into the bag of FIG. 1.

In FIG. 7 is shown an optional, removable accessory pad that can be used as an extra seat or a pillow. The pad can be used as as a divider for the interior of the tote bag.

The tote bag of this invention is simple, yet highly versatile. For example, the exterior surface of the bag can be water repellent, and the inner liner made of a quilted cotton for warmth and softness, which is useful for outdoor events even in foul weather or for other activities. When fully opened it becomes a blanket, useful for the beach, picnics, exercising, lounge chairs, or it can be wrapped around the shoulders for keeping out the chill of evening air when camping, or if it starts to rain at an outdoor sporting event. With its hood, it can become a hooded poncho. It can be easily carried in an automobile for use as an emergency blanket. When folded vertically in half, it becomes a two-sided repellent pad that can be used for changing tires or installing tire chains, and so forth.

Numerous other advantages attend this invention.

CONCLUSION

The present invention is thus provided. Numerous adaptations and modifications can be effected by those of skill in the art within the spirit of this invention, the asserted scope of which is particularly pointed out by the following distinctly claimed subject matter.

What is claimed is:

1. A sheet assembly useful as a multipurpose tote bag, which comprises one integral material sheet, adapted to be folded in a first folding operation in an overlapping manner along vertical and horizontal axes from predetermined folding lines to form a folded sheet formation in which folded portions form a top opening and two inside portions of the tote bag, and adapted to be folded in a second folding operation along a center folding axis to form a bottom of the tote bag, and adapted to be formed into its tote bag formation by means of two pairs of fastener attachments in parallel along the vertical axes, with mating parts of each fastener attachment in parallel and extending from the bottom to the top opening of the tote bag, the assembly being rectangle-shaped, and wherein handles are present along an exterior surface thereof and disposed along horizontal folding axes, the fastener attachments in parallel along the vertical axes are zippers, and the exterior surface is water repellent, the assembly further having a hood attachable centrally along a vertical border thereof.

2. The assembly of claim 1, having a quilted interior.

3. The assembly of claim 2, with a removable pad.

4. A sheet assembly useful as a multipurpose tote bag, which comprises one integral material sheet, adapted to be folded in a first folding operation in an overlapping manner along vertical and horizontal axes from predetermined folding lines to form a folded sheet formation in which folded portions form a top opening and two inside portions of the tote bag, and adapted to be folded in a second folding operation along a center folding axis to form a bottom of the tote bag, and adapted to be formed into its tote bag formation by means of two pairs of fastener attachments in parallel along the vertical axes, with mating parts of each fastener attachment in parallel and extending from the bottom to the top opening of the tote bag, and which has a hood attachable along a vertical border thereof.

* * * * *